US005408839A

United States Patent [19]

Kitaichi et al.

[11] Patent Number: 5,408,839

[45] Date of Patent: Apr. 25, 1995

[54] REFRIGERANT COMPRESSOR

[75] Inventors: Shoichiro Kitaichi; Shinobu Sato, both of Kanagawa, Japan

[73] Assignee: Kabushiki Kaisha Toshiba, Kanagawa, Japan

[21] Appl. No.: 908,745

[22] Filed: Jul. 6, 1992

Related U.S. Application Data

[63] Continuation of Ser. No. 674,872, Mar. 25, 1991, abandoned.

[30] Foreign Application Priority Data

Mar. 30, 1990 [JP] Japan ..... 2-83201

[51] Int. Cl.[6] ..... F25B 1/00

[52] U.S. Cl. ..... 62/114; 252/68; 418/179

[58] Field of Search ..... 62/114, 401; 252/68; 419/DIG. 1; 418/179

[56] References Cited

U.S. PATENT DOCUMENTS

| | | | |
|---|---|---|---|
| 3,704,964 | 12/1972 | Phelps | 417/312 |
| 3,743,454 | 7/1973 | Rinehart | 418/248 |
| 3,966,511 | 6/1976 | Zboril | 184/5.1 |
| 4,244,679 | 1/1981 | Nakayama et al. | 417/269 |
| 4,307,998 | 12/1981 | Nakayama et al. | 417/269 |
| 4,755,316 | 7/1988 | Magid et al. | 62/114 |
| 4,808,085 | 2/1989 | Nishitsuji . | |
| 4,990,067 | 2/1991 | Sasano et al. | 417/DIG. 1 |

FOREIGN PATENT DOCUMENTS

| | | | |
|---|---|---|---|
| 2581132 | 4/1986 | France . | |
| 56-058495 | 5/1981 | Japan . | |
| 56-108853 | 8/1981 | Japan . | |
| 0183881 | 10/1983 | Japan | 417/DIG. 1 |
| 1-271491 | 4/1988 | Japan . | |
| 1-256594 | 10/1989 | Japan . | |
| 1250873 | 10/1971 | United Kingdom . | |
| 1482724 | 8/1977 | United Kingdom . | |
| 2147007 | 5/1985 | United Kingdom . | |

OTHER PUBLICATIONS

"Friction and Wear Characteristics in a Flon Atmosphere D-9", Honma and Komatsuzaki, Hitachi Laboratories, Hitachi Seisakusho (translated) Nov. 1989.

*Primary Examiner*—Henry A. Bennett
*Assistant Examiner*—William C. Doerrler
*Attorney, Agent, or Firm*—Banner, Birch, McKie & Beckett

[57] ABSTRACT

A refrigerant compressor comprises an hermetic type casing. There is refrigerant circulating in the casing. A compression mechanism in the casing has a first and a second part. These parts are made of iron-based metal and nodular cast iron, respectively. The first and the second parts may be coupled slidably.

16 Claims, 3 Drawing Sheets

FIG.1.
(PRIOR ART)
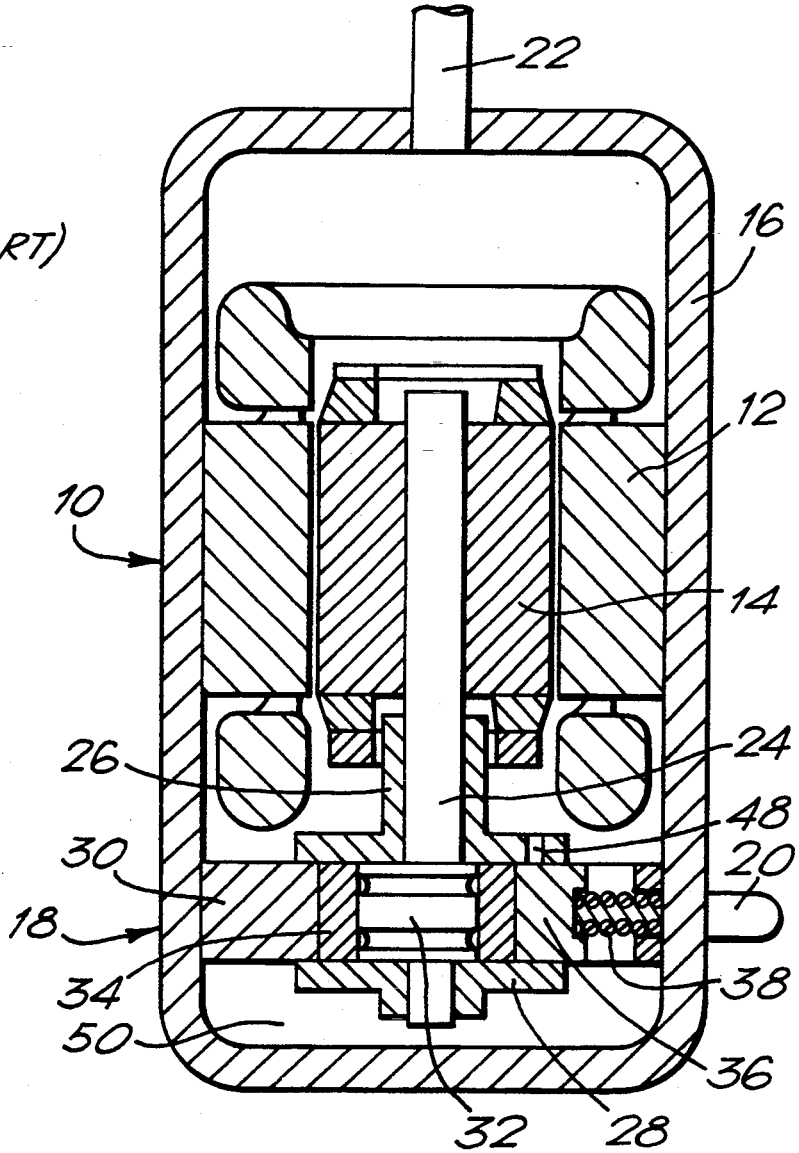
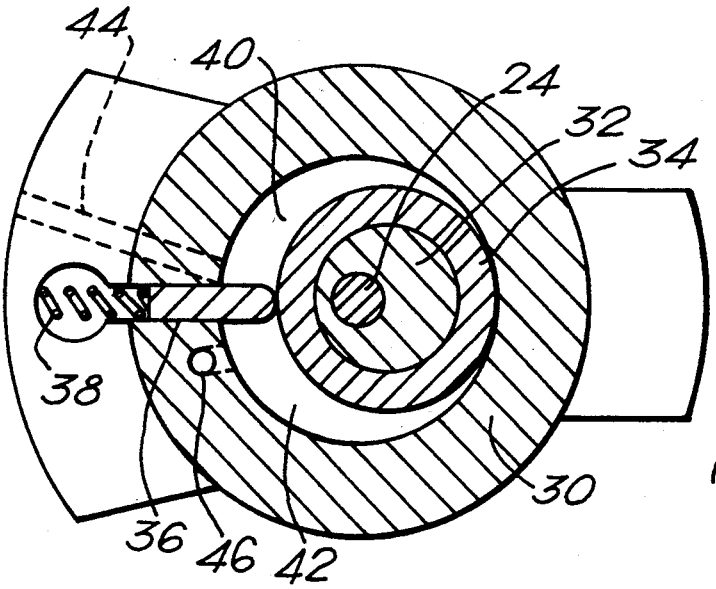
FIG.2.
(PRIOR ART)

REFRIGERANT COMPRESSOR

This application is a continuation of application Ser. No. 07/674,872, filed Mar. 25, 1991, now abandoned.

BACKGROUND OF THE INVENTION

1. Field of the Invention

The present invention relates to refrigerant compressors and, in particular, to an refrigerant compressor using 1,1,1,2-tetrafluoroethane as refrigerant.

2. Description of the Related Art

Generally, in air conditioning apparatus or refrigerators, a refrigeration cycle is used to cool or warm circulating air by heat exchange with a refrigerant moving through a closed, hermetic cycle. The refrigeration cycle has a refrigerant compressor for compressing the refrigerant and circulating the compressed refrigerant.

There are hermetic rotary compressors and semi-hermetic type refrigerant compressor for a car air conditioner and so on as a refrigerant compressor.

Dichlorodifluoromethane (hereafter referred to as CFC 12) or chlorodifluoromethane is used mainly as the refrigerant in the hermetic type refrigerant compressor. As the refrigeration compressor lubricants enclosed in compression mechanism 18, mineral oil of napthene or paraffine is used. These oils have solubility in CFC 12 and chlorodifluoromethane.

The above refrigerant and refrigeration compressor lubricants circulate directly inside of easing 16. There is a need to reduce wear on the various contact surfaces in compression mechanism 18.

Recently, it is recognized that discharge of CFC 12 from the refrigerant destroys the ozone layer, affects the biological system and affects human health. Therefore, CFC 12 is to be gradually reduced in its use and may be prohibited for any use in the future.

In view of the need for a replacement for CFC 12, 1,1,1,2-tetrafluoroethane (hereafter referred to as HFC 134a) and 1,1,2,2-tetrafluoroethane (hereafter referred to as HFC 134) were developed. This shift away from CFC 12, however, has changed the type of lubricants that can be used and affected the construction materials used in the compressor. For example, HFC 134a is hardly dissolved in the conventional mineral oil refrigeration compressor lubricant. Thus, polyalkylene glycol oil, polyether oil, polyester oil or fluorine oil (which all have solubility in the HFC 134a) have been used as the refrigeration compressor lubricant.

However, if the HFC 134a is used as refrigerant and the polyalkylene glycol oil or the polyester oil is used as refrigeration compressor lubricant, when materials such as FC 25 (grey cast iron), S-15C, S-12C (both are carbon steel), SWRCH10A, SWRCH15A (both are carbon steel wire rods for cold heating and cold forging), SCM435H (chromium molybdenum steel), sintering alloy, or stainless steel are used as parts of the compression mechanism, the mechanism is less wear resistant. Then, the problem occurs that the refrigerant compressor may not be operated stably for long time. This change may be explained by the absence of interactions between the lubricant and the iron in the mechanism.

If CFC 12 is used as refrigerant, the iron chloride (FeCl) film having good wear-proof is formed because chlorine (Cl) atoms in CFC 12 reacts with iron (Fe) atoms as metal base. However, if HFC 134a is used as refrigerant, lubricating film such as iron chloride (FeCl) film is not formed because chlorine atoms do not exist in HFC 134a. This is one of the reasons of above problem.

Moreover, refrigeration compressor lubricants that are soluble in HFC 134*a* are aliphatic compounds rather than cyclic compounds. Aliphatic compounds do not, however, provide an adequate thickness of a lubricating oil film so it is hard to maintain adequate lubrication under hard rubbing conditions. This is one of the reason why wear-resistance is decreased.

SUMMARY OF THE INVENTION

Accordingly, it is an object of the present invention to provide an improved refrigerant compressor which has improved wear-resistance and, longer operating life. In accordance with the present invention, the foregoing object is achieved by providing a refrigerant compressor, which comprises a hermetic type casing, refrigerant circulating in the casing, and a compression mechanism having a first part comprising an iron-based metal and a second part nodular cast iron and being in frictional contact with said first part for at least some period of time during operation of said compressor.

BRIEF DESCRIPTION OF THE DRAWINGS

A more complete appreciation of the present invention and many of its attendant advantages will be readily obtained by reference to the following detailed description considered in connection with the accompanying drawings, in which:

FIG. 1 provides a longitudinal sectional view of one example of a hermetic, rotary type compressor and to which the present invention also may be applied.

FIG. 2 is a cross sectional view of the hermetic type compressor shown in FIG. 1.

DETAILED DESCRIPTION OF THE PREFERRED EMBODIMENT

The preferred embodiment of the present invention will now be described in more detail with reference to the accompanying drawings.

First, before describing the embodiment, nodular cast iron and iron-based metal are described which are adopted as material of parts of a compression mechanism according to the present invention.

Nodular cast iron according to the present invention is made by changing flake graphite into ball-shaped gloves or spheres by chemical element additive (for example magnesium) or a heating process. By changing the graphite shape, surface pitting is much less than that of flake graphite. The modulus of elasticity of the nodular cast iron is increased, and the mechanical strength of the iron is improved.

Reducing the occurrence of surface pitting is important because extraordinary wear may happen if sharp edges of nodular cast iron are exposed on the slide surface. Thus, the sharp edges are desirably avoided or removed shortly after formation.

The ratio of roundness of graphite is calculated by the calculation method of JIS (Japanese industrial standards) G 5502. The ratio is desirable to be more than approximately 40%. The calculation method is as follows. That is, spherical graphite which exists in a matrix (Fe—C solution Solid) is observed by a optical microscope. Then, a ratio of areas of spherical graphite and a true circle whose diameter is corresponding to maximum length of spherical graphite is calculated. This ratio shows a degree of roundness of actual graphite to ideal spherical graphite. Additionally, ASTM A247 in U.S.A. is corresponding to the calculation method of JIS G5502.

Figure 3:
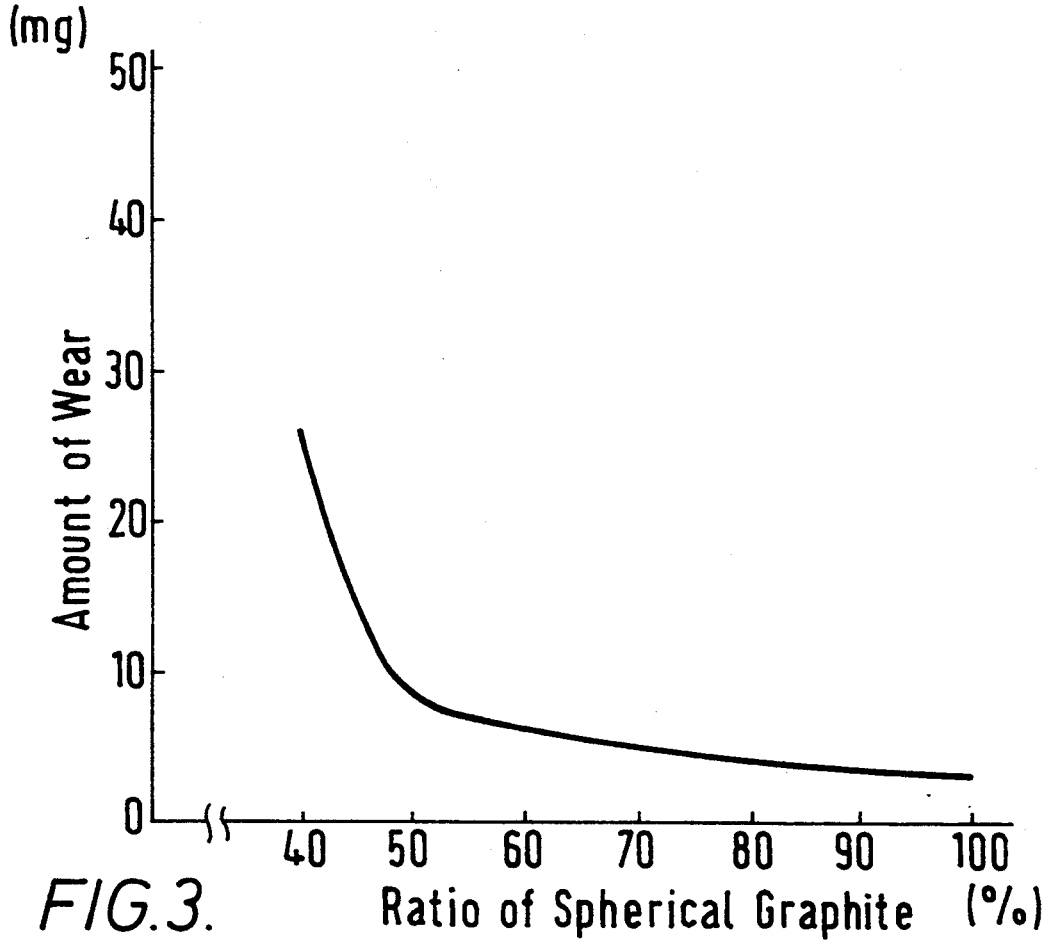
FIG. 3 illustrates the relationship between ratio of making globular of graphite and amount of wear of it.

This ratio is desired because the amount of wear of graphite cast iron is large and the effect of wear resistance is not obtained if the roundness ratio is less than approximately 40%. As shown in FIG. 3, the relationship between the roundness ratio of graphite and amount of wear. The roundness ratio is preferably as high as possible, e.g., at least about 40%, preferably 50%–100%, and more preferably about 70%–100%. The wear-resistance is increased as the ratio of roundness is closer to 100%.

As a method of converting graphite in cast iron into a spherical form, the method of melting cast iron with a small amount of impurities (especially sulfur), annexing cerium (Ce) (more than 2%) or magnesium (Mg) (more than 0.04%), and adding ferroscilicone at the rate of 0.4% to 0.8% is useful. Besides above method, Ca, Na, K, Li, Ba, Sr, and Zn may be used because they are chemical elements which have an ability to make graphite into a spherical form.

In the present invention, examples of iron-based metals include cast iron, steel, and sintering alloy. Sintering alloy is made by the below method. First, alloy powder including element(s) which composes the alloy is made, and then the alloy powder is filled in a mold having predetermined shape. Finally, the allow powder is formed by giving pressure in a condition of high temperature. The alloy powder includes, for example, only Fe (SMF I), Fe and Cu (SMF II, where Cu is annexed to Fe in a ratio of 0.5 through 3.0%), Fe and C (SMF III, where C is annexed to Fe in a ratio of 0.2 through 0.8%), or Fe, C and Cu (SMF IV, where C and Cu are annexed to Fe in ratios of 0.2 through 1.0% and 1.0 through 5.0%, respectively) as element(s). SMF (Sintered Materials for Structual Parts) I through IV are typical sintering alloy under the JIS. Sintering alloy has porosity, and holds oil in the many openings on the rubbing surface thereof. Sintering alloy may actually act as a supply of lubricating oil by itself if the condition of insufficiency of lubricating oil occurs. Because oil is trapped in the surface, the alloy's porosity is sealed against leakage of pressure fluid from adjacent openings existing in the surface and body of the sintering alloy. Sintering alloy is strong so it may be used in parts that must withstand compression.

If higher wear-resistance and corrosion resistance are needed, sintering alloy may be processed in an oxygen-containing atmosphere at 500° C. to 600° C. The oxygen forms a cover film of $Fe_3O_4$ on the surface of sintering alloy which acts as a hard coating for the surface. Thus, sintering alloy is very useful as a material of parts in frictional contact.

Also in the present invention, the ratio of porosity $R_p$ in the alloy is calculated by the following equation and desirable to be less than 30%.

$$R_p = 1 - (P/P0)$$

-continued $$p = \frac{(W2 - W0)''Ps}{(W2 - W0) - (W1 - W3)}$$

where P is density of particle (kg/m$^3$), Ps is density of liquid refrigerant (kg/m$^3$), P0 is true density of particle (kg/m$^3$), W0 is weight of the specific gravity flask (kg), W1 is weight of the specific gravity flask filled with liquid refrigerant after a sample is put into the specific gravity flask (kg), W2 is mass of the specific gravity flask into which the sample is put (kg), W3 is mass of the specific gravity flask filled with only liquid refrigerant (kg).

It is not desirable that the ratio of porosity is over 30% because airtightness and strength may not be adequate.

According to the present invention, steels useful for the invention include hypoeutectic carbon steel, eutetic carbon steel, hypereutectic carbon steel, etc. The eutectic carbon steel includes about 0.77 weight % carbon. The hypoeutectic and hypereutectic carbon steel includes less than 0.77 weight % carbon and more than 0.77 weight % carbon, respectively. For adequate strength, the carbon content in the steel is desirable to be 0.05 through 1.0 weight %.

Refrigeration compressor lubricants useful for the invention include polyether compounds such as polyalkylene glycol, ester compounds such as complex type polyester oil, fluorine oils which have solubility in HFC 134a. Solubility is necessary for preventing separation and deposit of refrigeration compressor lubricant in pipes in refrigerant cycle and for returning refrigeration compressor lubricant to a compressor. Polyglycol oil (one of the useful polyether compounds) is suitable as refrigeration compressor lubricant because the viscosity index of the oil is high and flow ability at low temperature is good even though the oil absorbs moisture.

Example 1A

The preferred embodiment of the present invention will now be described below in more detail with reference to the accompanying drawings.

FIG 1 is a longitudinal sectional view of one example of a hermetic type compressor. FIG. 2 is a cross sectional view of the hermetic type compressor shown in FIG. 1. This type compressor is also described in, for example, U.S. Pat. No. 4,808,085.

The refrigerant compressor and its compression mechanism in FIGS. 1 and 2 are described below as a sample of refrigerant compressors and their compression mechanisms.

In FIG. 1, a motor 10 comprising a stator 12 and a rotor 14 is supported in a hermetically sealed casing 16. A compression mechanism 18 is supported under motor 10 in easing 16. Compression mechanism 18 is derived by motor 10. By compression mechanism 18, refrigerant introduced from a supply tube 20 is compressed and discharged into casing 16. After that, the refrigerant is supplied to a discharge tube 22, which is positioned on the upper portion of easing 16, to an expansion chamber of a refrigerator (not shown).

Compression mechanism 18 is detailed below also using FIG. 2.

A shaft 24 rotated by motor 10 is supported by a flange 26 at the center portion of shaft 24 and supported by a sub-bearing 28 at the end portion of shaft 24. A cylinder 30 is supported at the lower portion of casing 16. A crank member 32 is fixed eccentrically to shaft 24 at the position of cylinder 30. A cylindrical roller 34 surrounds crank member 32, and is moved eccentrically from the movement of crank member 32 by the rotation of shaft 24.

Blade 36 extends through cylinder 30 (see FIG. 2). The inner area of cylinder 30 is separated into an inlet chamber 40 and a discharge chamber 42 by blade 36. The one end of blade 36 extending into cylinder 30 contacts the outer surface of roller 34 with pressure from spring 38. Blade 36 is reciprocated according to the eccentric movement of roller 34.

As shaft 24 rotates, refrigerant gas enters from an inlet 44 provided in cylinder 30 and is compressed, and discharged from a nozzle 46 provided in cylinder 30. Nozzle 46 has an inlet portion facing discharge chamber 42, and an outlet portion on the upper surface of cylinder 30. The position of the outlet portion of nozzle 46 coincides with the position of a hole 48 (see FIG. 1) provided in flange 26. Refrigerant discharged from discharge chamber 42 is supplied to discharge tube 22 through nozzle 46, hole 48 and an opening of motor 10. Refrigeration compressor lubricant 50 is supplied inside of the casing to smooth the movement of roller 34. Refrigeration compressor lubricant 50 is pumped up along a pump (not shown) arranged under shaft 24, and lubricates the sliding portions of compression mechanism 18 such as between cylinder 30 and blade 36 in addition to between the contact surface roller 34 and blade 36.

Blade 36 is rubbed by the inner surface of aperture in cylinder 30 by the pressure difference between inlet room 40 and discharge room 42 when it is reciprocated. Blade 36 and cylinder 30 are worn away. The outer surface portion of roller 34 is also worn away because blade 36 is contacted with roller 34 by spring 38.

Meanwhile, shaft 24 is rotated at high speed in an eccentric path while receiving pressure from spring 28 and pressure in cylinder 30 via roller 34. Shaft 24 is pressed against flange 26 and sub-bearing 28. Thus, wear occurs between the outer surface of shaft 24 and the inner surface of flange 26 and sub-bearing 28.

In the first embodiment, a shaft 24 and a cylinder 30 in FIG. 1 are made of FCF 60 (nodular cast iron) whose ratio of spherical graphite is approximately 100%. Bearing 28 and roller 34 in FIG. 1 are made of S-15C (carbon steel). Both material of FCD60 and S-15C are under JIS.

Above shaft 24 and cylinder 30, bearing 28 and roller 34 are cut from their respective materials and then, degreased by cleaning with acetone. Finally, a refrigerant compressor having the same structure as that shown in FIG. 1 is constructed using the above parts. Accordingly, shaft 24 (nodular cast iron) is in frictional contact with bearing 28 (carbon steel) and cylinder 30 (nodular cast iron) is in frictional contact with roller 34 (carbon steel) when compression mechanism 18 is operated.

The refrigeration compressor lubricant is polyalkyleneglycol oil and HFC 134a is used in the compressor as the refrigerant.

The effect by the embodiment is described below.

The refrigerant compressor of the embodiment was operated for 500 hours to confirm the effect of the embodiment. After the operation, the surface of shaft 24 was observed by a scanning electron microscope (SEM). The result was that hardly any sign of abrasion was recognized.

Example 1B

Figure 4:
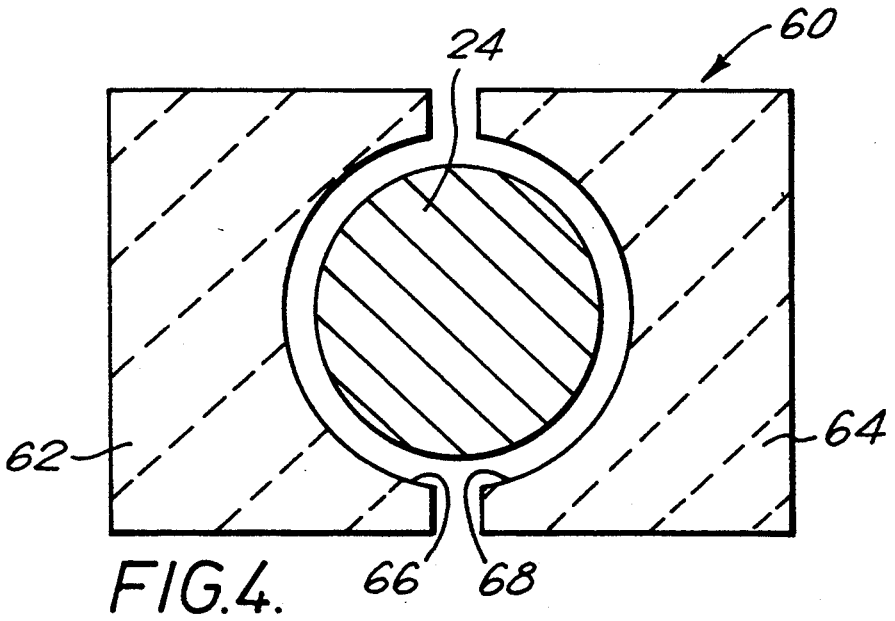
FIG. 4 is a sectional view of a wear tester.

The wear-resistance of shaft 24 from Example 1A was examined using a wear tester shown in FIG. 4. This tester 60 includes V-blocks 62, 64 having concavities 66, 68, respectively. Shaft 24 is binded by V-blocks 62, 64. Load by binding by V-blocks 62, 64 is designed to be constant. Amount of wear for a predetermined period is examined by rotating shaft 24 and injecting refrigerant.

In this wear test, HFC 134a was injected into the space between V-blocks 62, 64 and shaft 24. Shaft 24 was rotated at 290 rpm for 30 min. with load weight 135 kgf. Shaft 24 was made of above material, that is, nodular cast iron. V-blocks 62, 64 were made of the same material as bearing 28, that is, steel.

Figure 5:
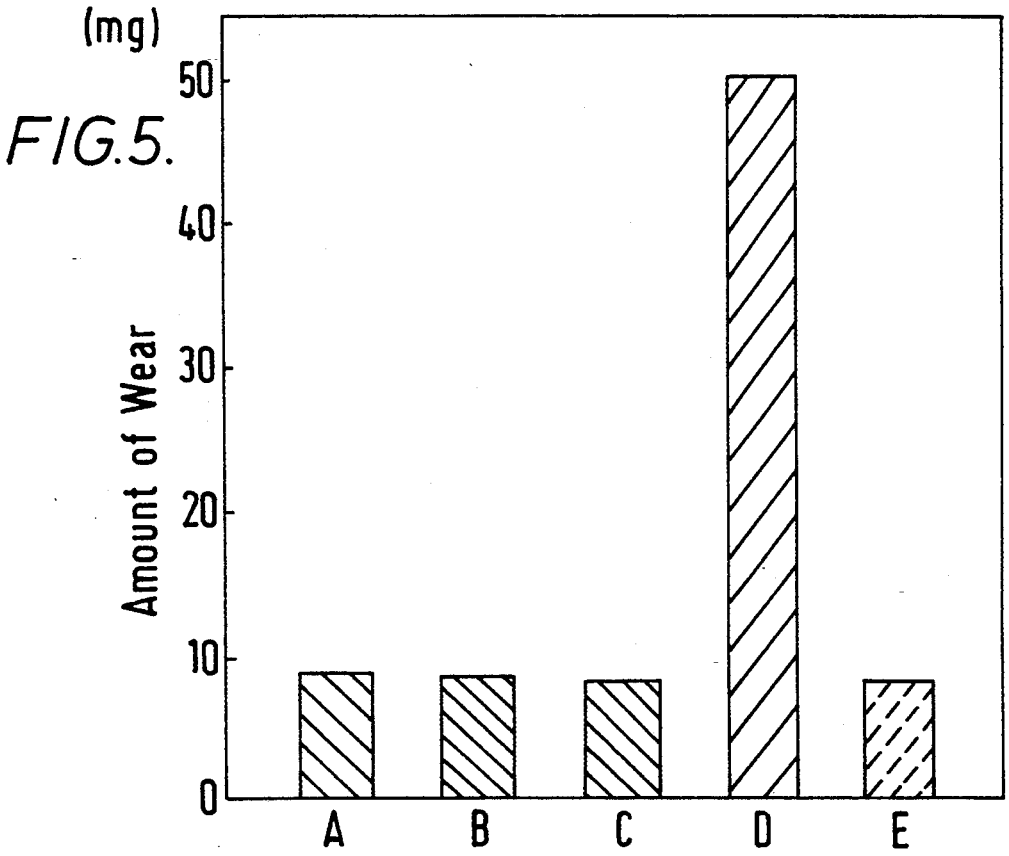
FIG. 5 illustrates a result of tests of amount of wear of the shaft shown in FIG. 1 when constructed according to the present invention.

The result of the test was that the amount of wear was approximately 8 mg as shown in "A" of FIG. 5.

Example 2A

Another embodiment is now described below.

In Example 2A, both a shaft 24 and a cylinder 30 are made of nodular cast iron whose ratio of spherical graphite is approximately 100%. A bearing 28 and a roller 34 are made of grey cast iron. Other conditions in the refrigerant compressor of the second embodiment are the same as the first embodiment.

The refrigerant compressor of Example 2A was operated for 500 hours like Example 1A. There was little sign of abrasion on the surface of shaft 24 to be recognized by the SEM after the operation.

Example 2B

The amount of wear of shaft 24 was about 7 mg (see "B" in FIG. 5) in the same wear test as in Example 1B. The result was good as well as the first embodiment.

Example 3A

In Example 3A, both a shaft 24 and a cylinder 30 are made of the same material as in Example 2A, that is, nodular east iron whose ratio of spherical graphite is approximately 100%. A bearing 28 and a roller 34 are made of iron-based metal sintering alloy. Other conditions are the same as Example 1A.

The refrigerant compressor of Example 3A was operated for 500 hours like Example 1A. There were little sign of abrasion on the surface of shaft 24 to be recognized by the SEM after the operation.

Example 3B

The amount of wear of shaft 24 was about 6.5 mg (see "C" in FIG. 5) in the same wear test as in Example 1B. The result was good as well as the first embodiment.

On the above examples, parts coupled slidably, for example, bearing 28 and shaft 24, or roller 34 and cylinder 30 have nearly same hardness, desirably. It is because the part which has lower hardness than the other part is easy to be worn away if the difference of hardness between the parts is large. Hardness of material of parts may be coordinated to some extent by heating process or changing the carbon content.

Also in the above embodiments, shaft 24 and cylinder 30 are made of nodular cast iron, and bearing 28 and roller 34 are made of iron-based metal (cast iron, steel or sintering alloy). However, the relationship between the parts and the material may be inverted. That is, it is possible that shaft 24 and cylinder 30 are made of iron-based metal, and bearing 28 roller 34 are made of nodular cast iron.

Figure 6:
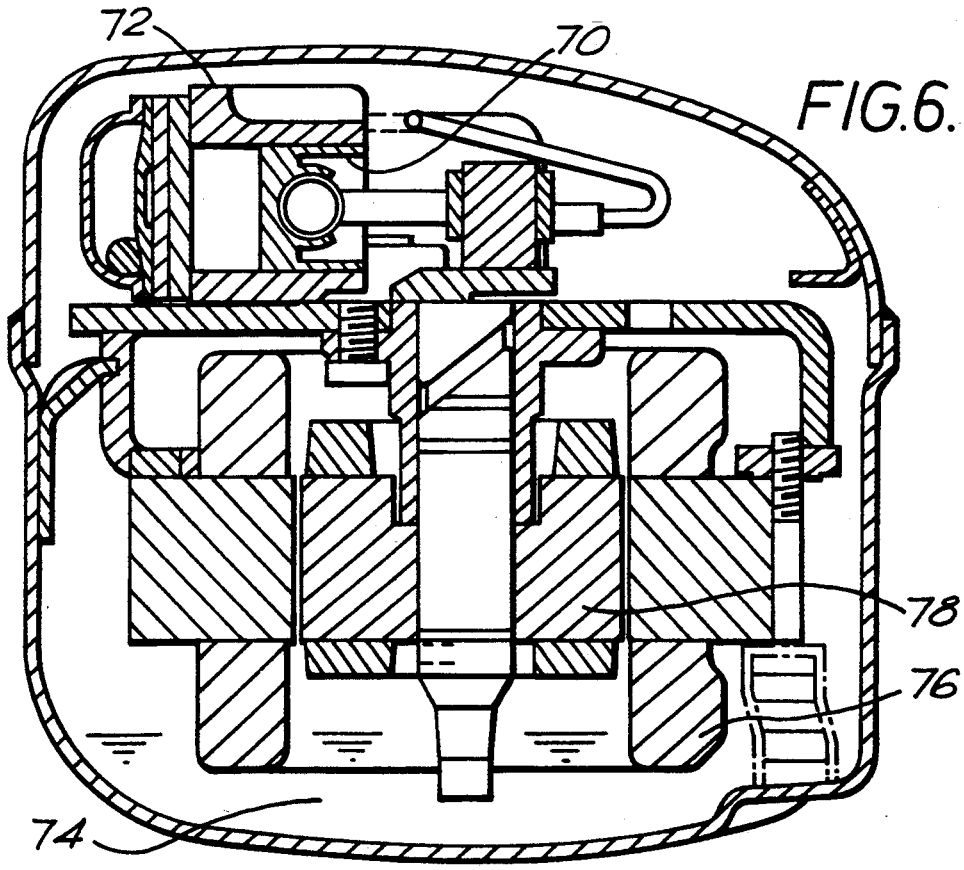
FIG. 6 provides a longitudinal sectional view of another example of a hermetic type compressor and to which the present invention may also be applied.

In the above embodiments, rotary type refrigerant compressors are described. However, the present invention also may be adopted to a reciprocation type refrigerant compressor as shown in FIG. 6. In this reciprocation type refrigerant compressor, a piston 70 which reciprocates in a cylinder 72 corresponds to roller 34 in the above embodiment. That is, piston 70 and cylinder 72 are coupled slidably in frictional contact during operation of the compressor and the combination of material of the piston 70 and cylinder 72 is pair of iron-based metal and nodular east iron. A motor 74 comprises a stator 76 and a rotor 78.

In the above embodiments, east iron includes free graphite. The free graphite operates as lubricant, and reduces wear of sliding parts. Graphite holds lubricant, and makes it easy to form an adequate oil film. Thus, graphite increases wear-proof as metal sliding material. Further, anisotropy during sliding friction disappears by making graphite into a spherical form. A particle of graphite holds more amount of oil so that nature of slide increases. By a combining iron-based metal with nodular cast iron as material of relative slide parts, good wear-registance is obtained in the operation in refrigeration compressor lubricant.

Comparative Example 1

As reference, a refrigerant compressor which used conventional material as slide parts and HFC 134a as refrigerant was operated to understand the effect of the embodiments. That is, shaft 24 and cylinder 30 were made of material FC 25 (grey cast iron), bearing 28 and roller 34 were made of material S-15C (carbon steel). Polyalkylene glycol oil was used as refrigeration compressor lubricant, HFC 134a was used as refrigerant.

The refrigerant compressor under the above condition was operated for 500 hours. After the operation, traces of abrasion were observed clearly on the surface of shaft 24 by using the SEM.

Wear of shaft 24 was tested by using the tester shown in FIG. 4 under the same conditions as Examples 1B–3B. Amount of wear was 50 mg ("D" in FIG. 5), and shaft 24 was understood not to be able to use for long time.

Comparative Example 2

As more reference, a refrigerant compressor which used prior art materials for sliding parts and conventional CFC 12 as refrigerant was operated. That is, shaft 24 and cylinder 30 were made of material FC 25 (grey cast iron), and bearing 28 and roller 34 were made of material S-15C (carbon steel). Paraffin mineral oil was used as refrigeration compressor lubricant. Above conditions are same conditions in a prior refrigerant compressor using CFC 12.

The refrigerant compressor was operated for 500 hours. Amount of wear was about 6 mg ("E" in FIG. 5).

From the result of reference experiments, it is understood that if HFC 134*a* (which do not include chlorine) is used as refrigerant in the compressor instead of CFC 12 , refrigeration compressor lubricant also needs to be changed to one suitable to HFC 134*a*.

It is claimed:

1. In combination:

a refrigerant compressor comprising an hermetic type casing and a compression mechanism having a first part comprising an iron-based metal and a second part comprising a nodular cast iron and being in frictional contact with said first part for at least some period of time during operation of said compressor;

a refrigerant comprising 1,1,1,2-tetrafluoroethane circulating in the casing; and a refrigeration compressor lubricant having solubility in said refrigerant.

2. The combination of claim 1, wherein the first and second parts are coupled slidably.

3. The combination of claim 1, wherein the compression mechanism is rotary type.

4. The combination of claim 3, wherein the first and second parts are a roller and a cylinder, respectively.

5. The combination of claim 3, wherein the first and second parts area bearing and a shaft, respectively.

6. The combination claim 1, wherein the compression mechanism is reciprocation type.

7. The combination of claim 6, wherein the first and second parts are a piston and a cylinder, respectively.

8. The combination of claim 6, wherein the first and second parts are a bearing and a shaft, respectively.

9. A refrigerant compressor comprising:

an hermetic type casing;

a refrigerant comprising 1,1,2,2-tetrafluoroethane circulating in the casing; and a compression mechanism having a first part comprising an iron-based metal and a second part comprising a nodular cast iron and being in frictional contact with said first part for at least some period of time during operation of said compressor.

10. A refrigerant compressor as claimed in claim 1, wherein the refrigeration compressor lubricant comprises a polyglycol oil.

11. A refrigerant compressor as claimed in claim 1, wherein graphite in the nodular cast iron of said second part has a roundness ratio of at least 40%.

12. A refrigerant compressor as claimed in claim 1, wherein the iron-based metal of the first part comprises cast iron.

13. A refrigerant compressor as claimed in claim 1, wherein the iron-based metal of the first part comprises steel.

14. A refrigerant compressor as claimed in claim 13, wherein carbon content in said steel is within the range from about 0.05 to about 1.0.

15. A refrigerant compressor as claimed in claim 1, wherein the iron-based metal of the first part comprises a sintering alloy.

16. A refrigerant compressor as claimed in claim 15, wherein a ratio of porosity of said sintering alloy is less than 30%.

* * * * *